United States Patent [19]

Propst

[11] 4,452,449

[45] Jun. 5, 1984

[54] OFFICE SEATING WITH ACTIVITY FEATURES

[75] Inventor: Robert L. Propst, Bellevue, Wash.

[73] Assignee: Herman Miller, Inc., Zeeland, Mich.

[21] Appl. No.: 360,529

[22] Filed: Mar. 22, 1982

[51] Int. Cl.[3] ..... A63B 21/02; A63B 21/14; A63B 23/04

[52] U.S. Cl. ..... 272/134; 272/96; 272/144

[58] Field of Search ..... 272/134, 900, 96; 128/25 R, 25 B; 297/115, 263–268, 347, 344, 417

[56] References Cited

U.S. PATENT DOCUMENTS

| | | | |
|---|---|---|---|
| 160,624 | 3/1875 | Spencer | 248/395 |
| 576,344 | 2/1897 | Eccleston | 297/267 |
| 2,479,175 | 8/1949 | McArthur | 297/318 |
| 2,609,032 | 9/1952 | Cramer | 297/317 |
| 2,966,203 | 12/1960 | Foulkes | 297/115 |
| 3,140,119 | 7/1964 | Offner | 297/417 |
| 3,567,280 | 3/1971 | Bradshaw | 297/318 |
| 4,169,574 | 10/1979 | Garvey et al. | 297/344 X |

FOREIGN PATENT DOCUMENTS

| | | | |
|---|---|---|---|
| 246498 | 5/1963 | Australia | 297/264 |

*Primary Examiner*—Richard J. Apley
*Assistant Examiner*—Chris Coppens
*Attorney, Agent, or Firm*—Stephenson and Boller

[57] ABSTRACT

An office seating system which incorporates certain activity features into the office seating arrangement allowing the occupant to obtain beneficial exercise during the performance of work tasks. The activities which may be performed include: pedal pumping by the feet; a rocking of the seat on the upright with the head being fixed; a recline motion; and a pull and relax motion for the arms. Various mechanisms are disclosed for providing the accomplishment of these activity functions by occupants.

10 Claims, 22 Drawing Figures

FIG. 2
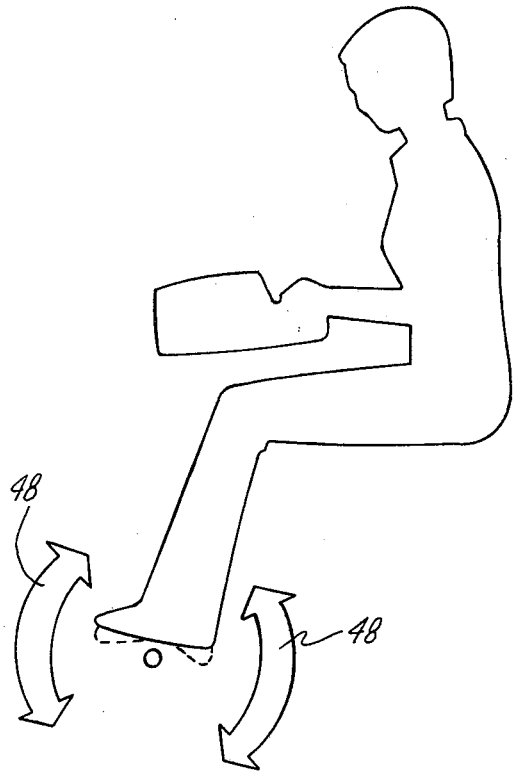
FIG. 3
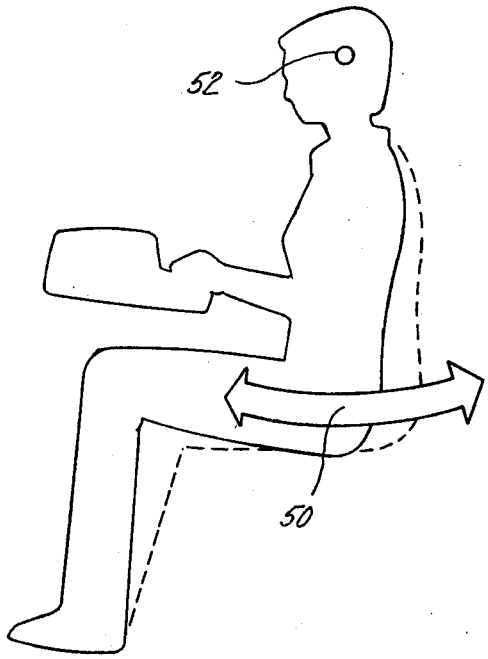
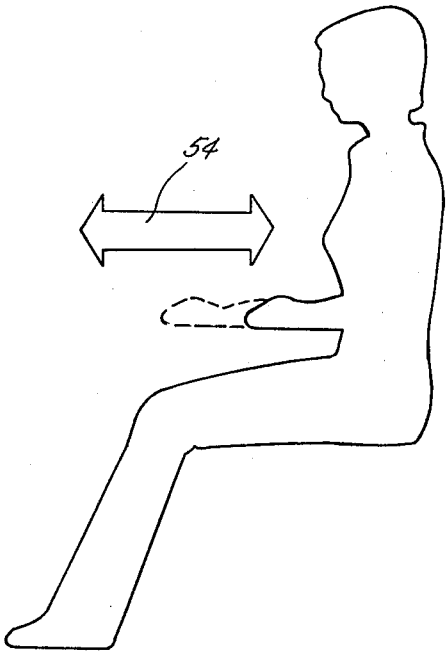
FIG. 4
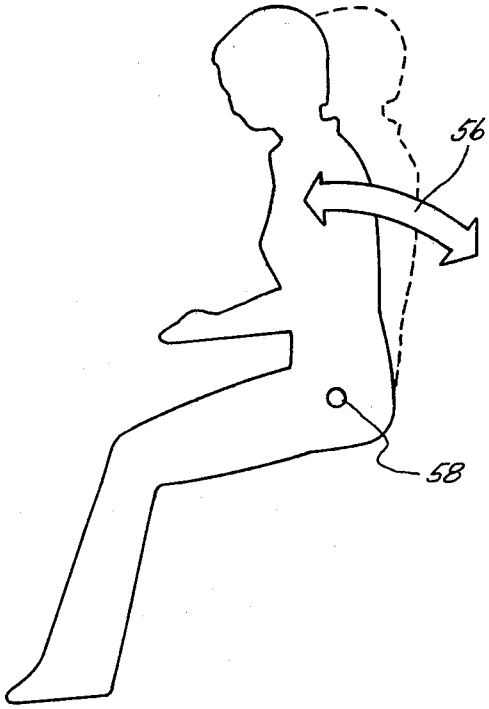
FIG. 5

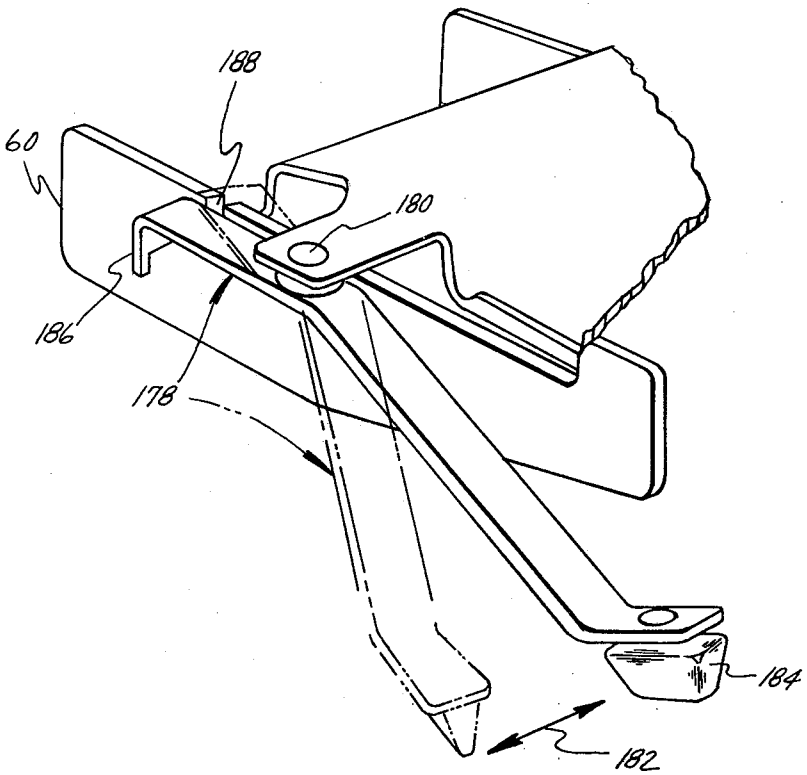
FIG. 13
FIG. 12
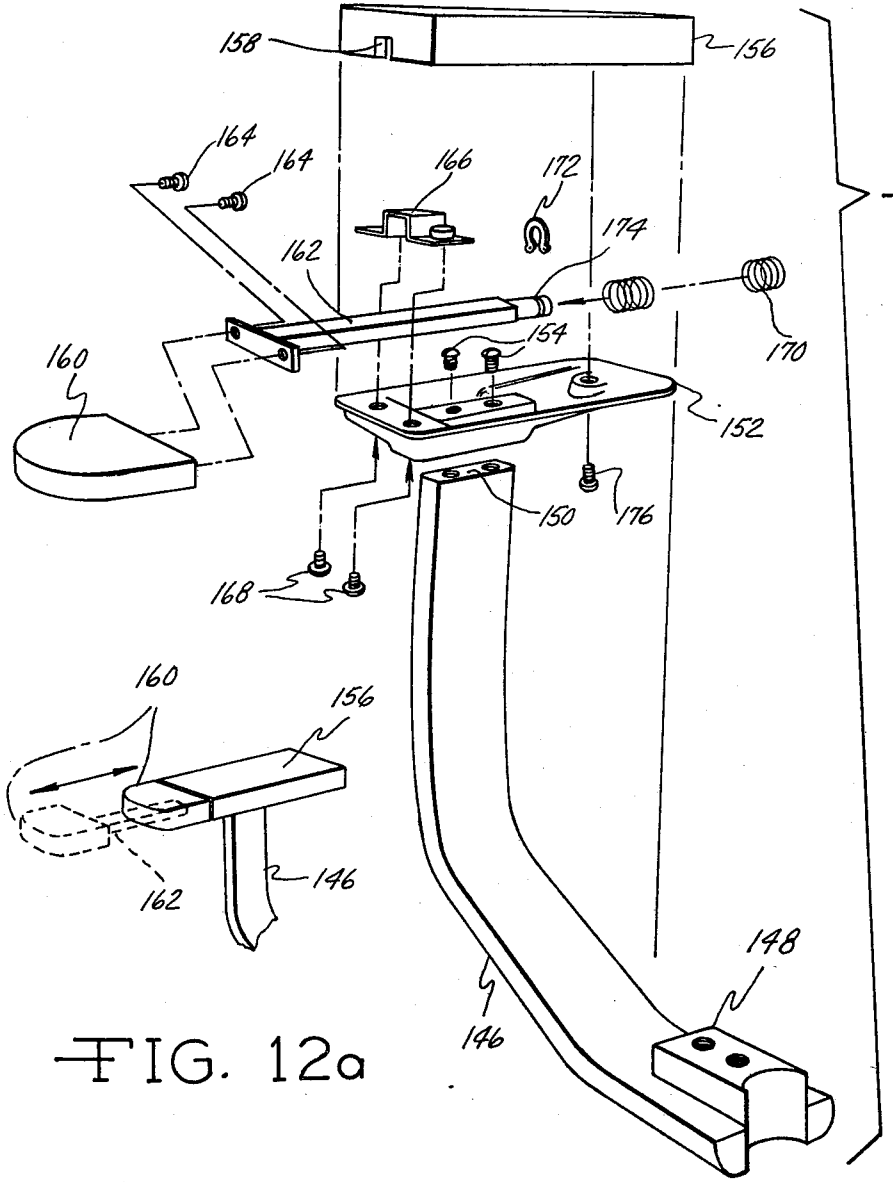
FIG. 12a

OFFICE SEATING WITH ACTIVITY FEATURES

BACKGROUND AND SUMMARY OF THE INVENTION

This invention relates to office seating and is concerned with the incorporation of activity features into office seating allowing the occupant to obtain beneficial exercise during the performance of work tasks.

The nature of a significant portion of today's office work involves principally sedentary activities. In other words performance of the typical office work tasks makes attendance at an individual's office work station essential for most of the work day. The design of conventional office work stations has heretofore been directed to optimizing the efficient conduct of the particular work tasks which are to be performed. This effort has failed to address the root causes of physiological problems which are related to sedentary activity although particular medical problems which can arise out of extended periods of sedentary office work activity have long been recognized.

The names given to certain of these problems, banker's leg, chair disease, loose back, etc., attest to the recognition of the relationship of certain diseases to extended periods of being seated. Whatever efforts have heretofore been made toward addressing these problems, have unfortunately heretofore not been directed to their root causes. The incorporation of various accessories, such as lumbar support devices, support cushions, etc., while possibly promoting the comfort of the occupant to a certain degree, do not address the underlying problem of sedentary activity, namely the lack of physiological exercise. Moreover it has not previously been recognized that therapeutic exercises can be conducted at a work station without interference with performance of work tasks.

The present invention is directed to a new and unique seating concept which provides a sedentary occupant with a means for conducting certain exercise activities concurrently with the performance of work tasks. In other words the invention provides various physical relief and exercise functions without interference with the normal work activity modes which are executed in the sitting position. Indeed it has now been discovered that the influence of the seating on the health, productivity, and satisfaction of the office and operational task worker can be very important. The present invention can provide an improvement in the physiological and psychological health of sedentary workers and can improve the effectiveness and efficiency of the knowledge worker.

The discoveries which have been made in connection with the present invention are such that they relate to various particular bodily functions which can be performed without interference with the usual work activity. These include the following: a pedal pumping motion in which the occupant's feet pump on a pedal pumping device; a rocking motion of the seat with the pivot point of the rocking arc being at the occupant's head so as to enable him or her to maintain task contact while carrying out posture relief movements which are beneficial to spinal tissue and muscle tone of the legs and trunk; a pull/relax motion which allows the occupant to flex his or her arms against a resistance improving muscle tone beneficial to the joint tissues of the arm and back; and a recline motion in which the back pivots without the seat tilting to allow for relief postures which maintain the angle between the thighs and trunk while maintaining support of the back.

In connection with the pedal pumping function the invention provides a foot pedal mechanism which comprises a treadle plate disposed at an angle to the floor allowing the occupant to place his or her feet on the treadle plate at a comfortable angle and with the legs extended so that the angle between the upper and lower legs is greater than 90° . The foot pumping motion is greatly beneficial in reducing blood stagnation originating in the veins of the legs. The ankle flexing action works the valves in the leg veins forcing blood up the leg and back to the heart. The beneficial therapeutic effect of a walking flex of the foot is well documented in medical literature. The placement of the feet also is beneficial in connection with spinal posture, particularly being beneficial to tissue of the spine.

The seat rocking motion with a pivot point of the rocking arc at the occupant's head enables him or her to maintain task contact with the work task at hand while carrying out posture relief movements. These movements are beneficial to spinal tissue and to the muscle tone of the legs and trunk.

The present invention discloses several embodiments of seating mechanism which allow the occupant to accomplish this type of rocking motion. In one embodiment the seat is supported on a pedestal through a track and roller arrangement. The track defines the nature of the rocking motion of the seat. The rocking motion may be executed against a yieldable resistance which may be embodied as an adjustable tensioning element. This allows the degree of resistance to be set for maximum benefit to the particular occupant.

In another embodiment the seat is mounted on the upright by means of a pair of four-bar links with one four bar link being spaced forwardly and the other rearwardly. A yieldable adjustment mechanism may also be employed with this embodiment. In yet another embodiment the seat is suspended from a fixed member by means of suspension arms for fore and aft motion with the suspension arms having pivotal joints comprising resiliently yieldable bushings.

The recline motion is imparted by means of a yieldably resilient mounting of the seat back with respect to the seat which is so constructed that during recline only the seat back and not the arms nor the seat tilt backwards. This allows beneficial activity to the back without undesirable effects which occur when the seat and the arm also recline, as in a conventional recliner office chair, impacting the undersides of table tops and impacting the knees.

The arm extension motion is provided by a hand grip which is mounted on an armrest for grasping and fore and aft movement by the occupant. The hand grip is operatively connected with a yieldable resistance in the form of a coiled spring disposed within the armrest which is compressed by the user during forward extension of the hand grip.

The foregoing features of the invention may be embodied individually or collectively in a given work station to provide the occupant with possibility of multiple exercise functions which may be executed at particular times in conjunction with particular work tasks. Accordingly the invention provides a new and unique approach to solving problems which although heretofore recognized, have not been effectively addressed in the office seating field.

The foregoing features, advantages, and benefits of the invention, along with additional ones, will be seen in the ensuing description and claims which should be considered in conjunction with the accompanying drawings. The drawings disclose preferred embodiments of the present invention according to the best mode contemplated at the present time in carrying out the invention.

BRIEF DESCRIPTION OF THE DRAWINGS

FIGS. 2 through 5 are various diagrammatic views illustrating different types of therapeutic activities which may be carried on at the work station of FIG. 1 while the occupant is performing particular work tasks.

FIG. 12 is exploded perspective view illustrating another portion of the chair, FIG. 12*a* showing the motion.

FIG. 13 is a fragmentary perspective view illustrating a further feature which may be incorporated into the chair.

DESCRIPTION OF THE PREFERRED EMBODIMENT

Figure 1:
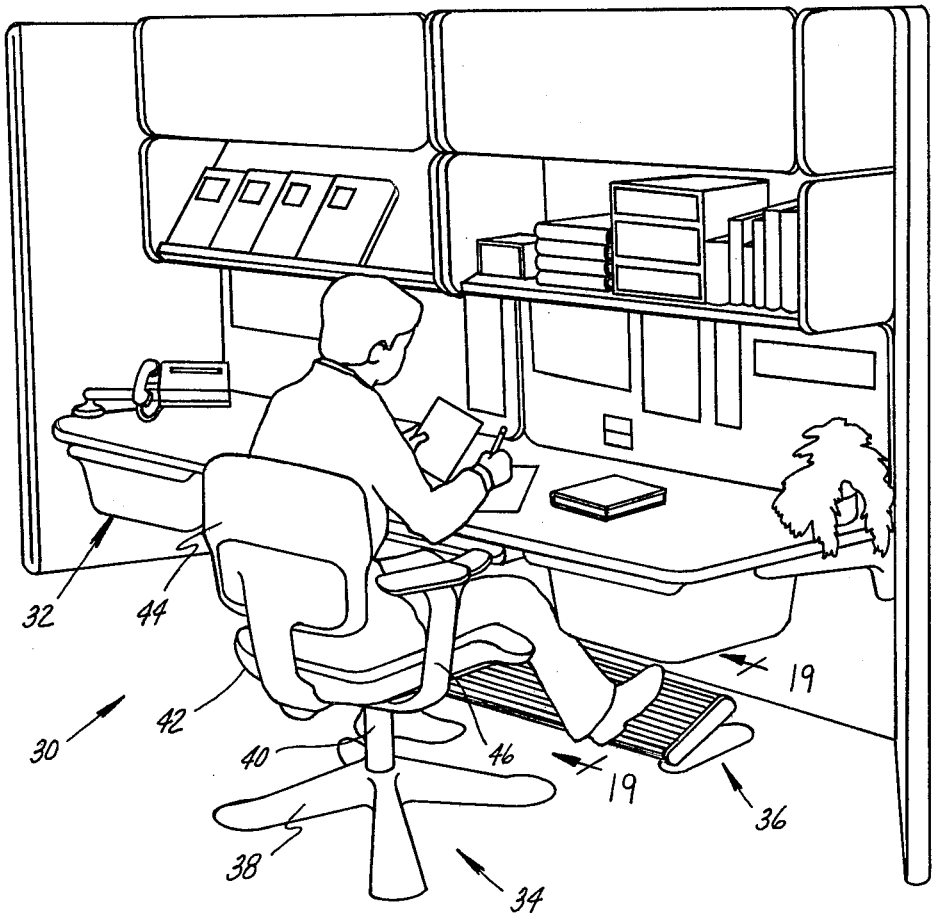
FIG. 1 is a perspective view of an example of an office work station embodying principles of the present invention.

FIG. 1 illustrates a work station 30 embodying principles of the present invention. The work station comprises a modular desk unit 32 and a chair 34. The chair 34 contains a number of the activity features in connection with the present invention, and the work station further includes a foot pedal pumping unit 36 also constituting one aspect of the present invention.

The illustrated work station is referred to as a managerial work station and the chair 34 is referred to as a managerial type chair. In this regard it has a base 38 which centrally supports a pedestal 40. The chair seat 42 is mounted on pedestal 40 and the chair back 44 and the arms 46 are also mounted on the seat pedestal. Most desirably base 38 provides a firm grip on the floor so that the chair is sturdily supported for the various activity motions which will be hereinafter described.

FIGS. 2 through 5 diagrammatically illustrate the types of activity motions which the occupant can perform while he or she is engaged in a work task. FIG. 2 illustrates a foot pumping activity in which the occupant places his or her feet on the foot pumping mechanism 36 to execute by leg and foot action a pumping motion as indicated by the arrows 48 in FIG. 2. Because only the legs and feet are involved in this particular activity motion, the occupant's upper body is stabilized for attendance to work tasks.

FIG. 3 illustrates a fore and aft rocking motion activity which may be executed by the occupant while he or she is engaged in a work task. In this regard the rocking motion is indicated by the arrow 50. The solid line position of the occupant illustrates a forward position while the broken line position illustrates an aft position. The rocking motion is centered about a pivot point 52 which is located at the occupant's head although the exact pivot point may be variable. The rocking motion, in the nature illustrated, is imparted by the occupant to the seat through leg action with the occupant's feet firmly planted on the floor. With the rocking motion centered generally about the occupant's head, the invention allows the occupant's hand-eye coordination to be stabilized on the work task at hand.

FIG. 4 illustrates an arm motion which may be executed by the occupant while performing a supervisory or non-manual work task. In this regard the occupant's body remains substantially stabilized for these types of work tasks while the occupant's arms execute a fore and aft motion as indicated by the arrow 54. The broken line position illustrates a forward position of the arms while the solid line position illustrates an aft position.

FIG. 5 illustrates a recline activity motion which may be executed. The recline motion involves a stabilization of the lower portion of the body from the pelvic region to the feet, the feet being placed on the floor. The recline motion is in the direction indicated by the arrow 56 about the pivot point 58 located at the pelvic region, and the recline activity is in the nature of a rocking motion centered at 58. The solid line position illustrates a forward position while the broken line position illustrates an aft position. In this regard, and as will be seen from the detailed description of the chair construction, the recline motion results solely in motion of the chair back. In other words there is no accompanying motion of the armrest or the seat. Thus at all times the rocking motion is effective in a therapeutic sense unlike conventional recliner chairs in which the seat and the armrest also recline with the back.

Normally the activities indicated by the preceding four drawing figures will be independently conducted by the occupant one at a time to the exclusion of the others. In all activity modes the occupant can remain in the active conduct of particular work tasks at hand. Thus in the case of the foot pedal pumping motion of FIG. 2 the occupant can concurrently engage in a work task such as typing, reading, supervising, writing, dictating etc. In the rocking activity of FIG. 3 the occupant can engage in similar work tasks to those described in connection with FIG. 2. In the FIG. 4 and 5 types of activities the particular nature of these activities may be less conducive to the concurrent performance of certain types of work activities, writing, typing or the like. However it is certainly possible to conduct supervisory, reading, or dictational work tasks in conjunction with the FIGS. 4 and 5 types of activities. Hence it can be perceived that the invention provides for the concurrent execution of both work tasks and various exercise activities which possess therapeutic value.

With this background description in mind it is now appropriate to consider details of the construction of chair 34. Therefore turning to FIGS. 6 and 7 one can see that the chair construction includes a mechanism via which the chair seat 42 mounts on pedestal 40 and which allows the fore and aft rocking motion to be executed. It also shows a reclining mechanism coupling the back 44 to the seat 42 which provides for the reclining motion. Affixed to the top of pedestal 40 is an axle support member 60 on which a pair of axles 62 and 64 are supported. The axles 62, 64 are disposed parallel to each other laterally of the chair and with the axle 62 being forwardly of pedestal 40 and axle 64 rearwardly. A pair of rollers 66 are mounted on each axle, one on either side of the upturned flanges of the member 60 containing the circular holes through which the axles pass. These rollers 66 are profiled with a crowned perimeter. Further rollers 68 are disposed on each axle just outboard of each roller 66. The rollers 68 have circular perimeters.

The seat 42 includes a track member 70 mounted on the underside of the seat. The track member 70 is provided with grooves 72 spaced symmetrically laterally of the upright and running fore and aft. Each groove 72 is profiled to receive the crowned profiles of the rollers 66. Thus the weight of the chair seat and occupant is borne by rollers 66, while the arrangement provides for fore and aft motion of the chair seat relative to the upright by rolling engagement of the track member 70 on the rollers 66. The crowned construction of the rollers 66 and the complementary crowned shape of the grooves 72 eliminates any lateral slack in the fore and aft motion.

The seat is constrained against upward vertical separation from the upright by means of flanged retainer pieces 74 which are assembled to the laterally outboard side edges of track member 70. The pieces 74 are assembled to member 70 after the chair seat has been placed on the rollers 66. The pieces 74 extend from members 70 downwardly and laterally inwardly so as to underlie the travel of rollers 66 as the seat is moved fore and aft over the range of fore and aft positions. The rollers 68 will have a rolling action with the lower flanged edges of the pieces 74, and thus the lower flanged edges of the pieces 74 are configured to correspond with the fore and aft profile of the grooves 72.

Figures 6, 7:
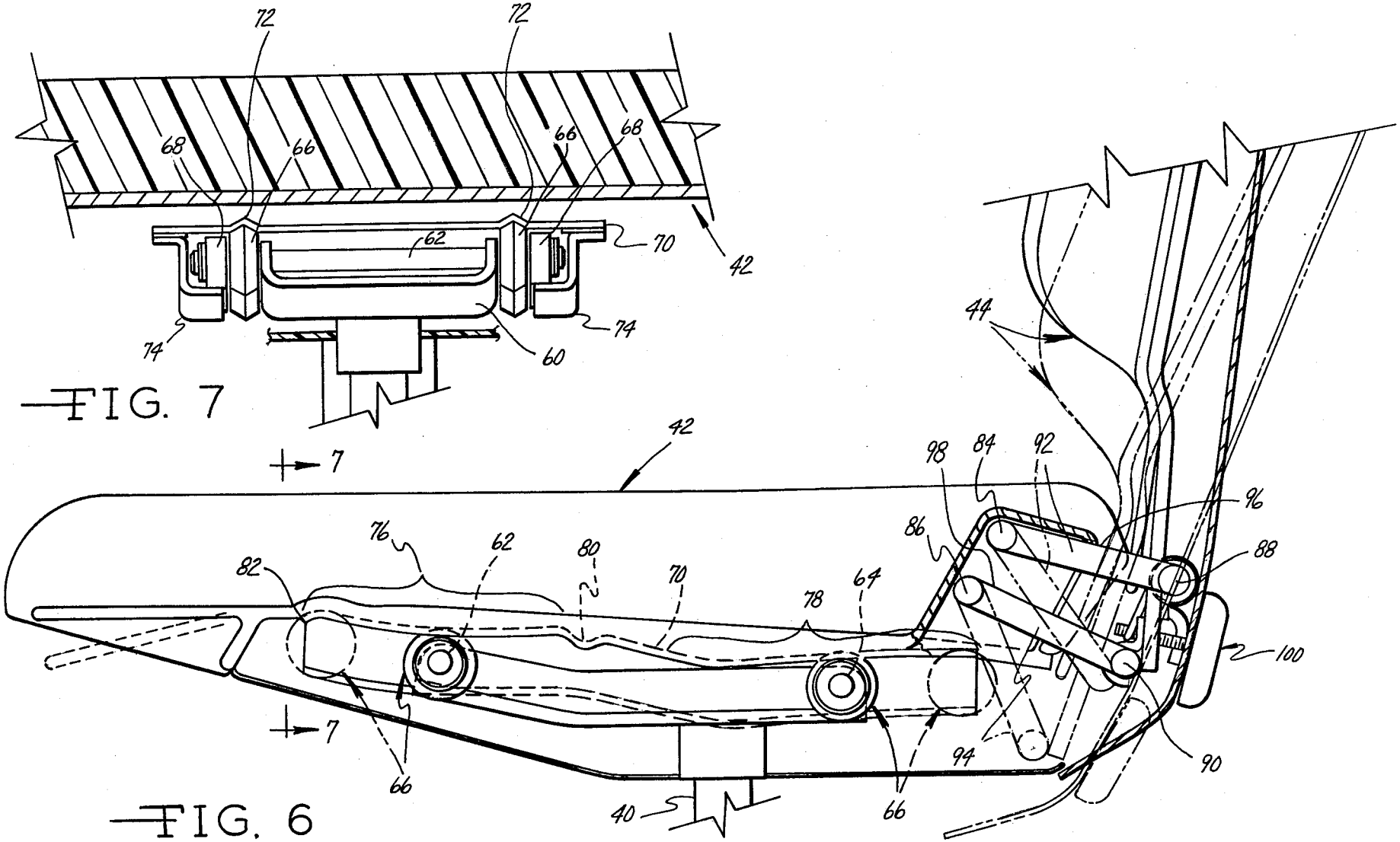
FIG. 6 is a fragmentary side elevational view partly in section of the chair which is used at the work station.
FIG. 7 is a fragmentary sectional view taken substantially in the direction of arrows 7—7 in FIG. 6.

The fore and aft profile of the grooves 72 can be perceived from consideration of FIG. 6. Each groove 72 contains a forward profile segment 76 and an aft or rearward profile segment 78. The rollers 66 which are on the front axle 62 ride within the front segments 76 while the rollers 66 which are on the rear axle 64 ride in the aft segments 78. A stop 80 is fashioned in each groove intermediate the segments 76 and 78. Stops 80 provide a rear stop for the front rollers 66 when the seat is displaced rearwardly to its maximum limit. Front stops 82 are also provided to engage the front rollers 66 and limit the maximum forward displacement on the seat on the upright. The amount of possible travel of the chair seat is selected to provide a meaningful range of rocking motion for the activity described in connection with FIG. 3 and the base of the chair is suitable to provide adequate stability for the occupant throughout the range of travel of the seat.

The reclining mechanism for the seat back 44 is also shown in FIG. 6. The mechanism may be considered as comprising a four bar link system. In the four bar link system one link is fixed on the chair seat while the opposite link is fixed on the chair back. Movable links connect the two fixed links together. Thus in FIG. 6 the reference numerals 84, 86, 88 and 90 respectively identify the pivot points of the four bar link. The link between the pivot points 84 and 86 constitutes the fixed seat length while the link between the pivot points 88 and 90 constitutes the fixed back link. The link between the pivot points 84 and 88 constitutes one movable link designated by the reference numeral 92 while the link between the pivots 86 and 90 constitutes the other movable link identified by the reference number 94.

The actual construction of the reclining mechanism comprises a pair of formed rods 96, 98 respectively. The rods are formed to provide links 92 and 94 on laterally opposite sides of the chair. There is a segment of the formed rod 96 extending between the two links 92 which is suitably secured to the chair back. This segment is colinear with the axis 88. Similarly there is a segment of rod 98 extending between the two links 94 which is secured to the chair back and this segment is colinear with the axis 90. Similarly there are segments of the rods 96, 98 respectively which are secured to the seat and are colinear with the axes 84 and 86. As can be seen in FIG. 6 suitable retention brackets and other structures are used to secure the rods to the chair components. There is also a spring tension adjustment 100 associated with the reclining mechanism which allows a spring adjustment to be made. The spring adjustment sets the amount of resistive force which is encountered when the occupant reclines the seat back and it may be set to suit the particular chair occupant.

The broken line position of FIG. 6 illustrates the chair back in a recline position while the solid line position illustrates an upright position. Clearly this illustrates how the four bar link mechanism is effective for reclining purposes. Importantly the reclining motion is unaccompanied by a corresponding tilting motion of either the seat or the arms of the chair. Thus a therapeutic effect is achieved and the arrangement can avoid problems which occur in other types of reclining chairs: for example pulling out the occupant's shirt; arms or chair hitting the desk.

Figure 8:
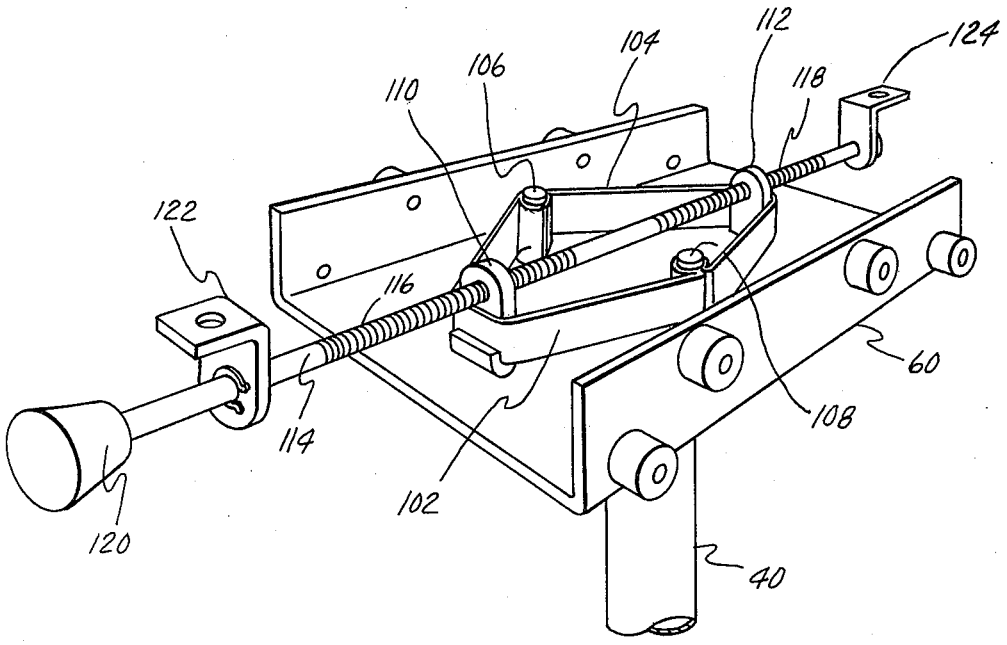
FIG. 8 is a fragmentary perspective view of a portion of a mechanism which may be used in conjunction with the chair seat.

FIG. 8 illustrates a feature which may be used with a chair seat such as the chair seat shown in FIG. 6. The chair seat which is shown in FIG. 6 has no resistive force, other than the inertia and the rolling resistance, to resist the rocking motion which is imparted to it by the occupant. The accessory of FIG. 8 provides a resistive force in the form of a tensioning mechanism whereby an increasing resistive force is encountered as the chair seat is displaced fore and aft away from the neutral centered position shown in FIG. 6.

The resistive device is disposed laterally centrally of the chair and is mounted on member 60 between the two upturned side flanges. Depending upon the relative dimensions involved for the various components, it may be desirable to eliminate the axles 62 and mount the rollers on roller shafts supported on either side of the flanges. The FIG. 8 embodiment shows this latter construction with the axles removed and replaced by the shorter roller shafts. The resistive mechanism comprises yieldable resistive elements 102, 104 in the form of yieldably expansible tension bands, such as elastomeric bands. The end of the bands are affixed to the member 60 at laterally spaced locations 106, 108. The band 102 is looped through a bracket 110 disposed forwardly of the upright, and the band 104 is looped through a similar bracket 112 disposed rearwardly of the upright. The members 110, 112 contain aligned threaded apertures through which a threaded adjustment rod 114 extends. The threaded adjustment rod contains a first thread section 116 engaging the bracket 110 and a second thread section 118 engaging the bracket 112. One of the threads 116, 118 is a right-hand thread while the other is a left-hand thread. Hence as shaft 114 is rotated by means of a knob 120 at the front end of the rod, the brackets 110, 112 are displaced fore and aft, either toward or away from each other. If the members 110 and 112 are moved increasingly apart, the respective bands 102, 104 are increasingly tensioned. Similarly if the members 110, 112 are moved closer together, the tension is relaxed.

Also affixed to shaft 114 are brackets 122, 124. The bracket 122 is attached to the front of the chair seat while the bracket 124 is attached to the rear of the chair seat. By virtue of this arrangement when the chair is operated by the occupant so as to move the seat forwardly of the upright, the occupant encounters a resistive force which is provided by the stretching of band 102. The elastic character of the band is such that the resistance increases as the seat is displaced increasingly forwardly. Similarly when the chair seat is displaced rearwardly from the neutral position, the band 104 is increasingly tensioned. In this way the occupant encounters resistive forces during operation of the seat during the rocking activity mode of FIG. 3. By matching the tension characterstics of the two bands the adjustment of the mechanism by operation of knob 120 does not result in any appreciable displacement of the chair seat from the central neutral position due to the counter-balancing effect of the two band members. The adjustment is however effective to adjust the magnitude of the resistive forces which are encountered.

Figure 9:
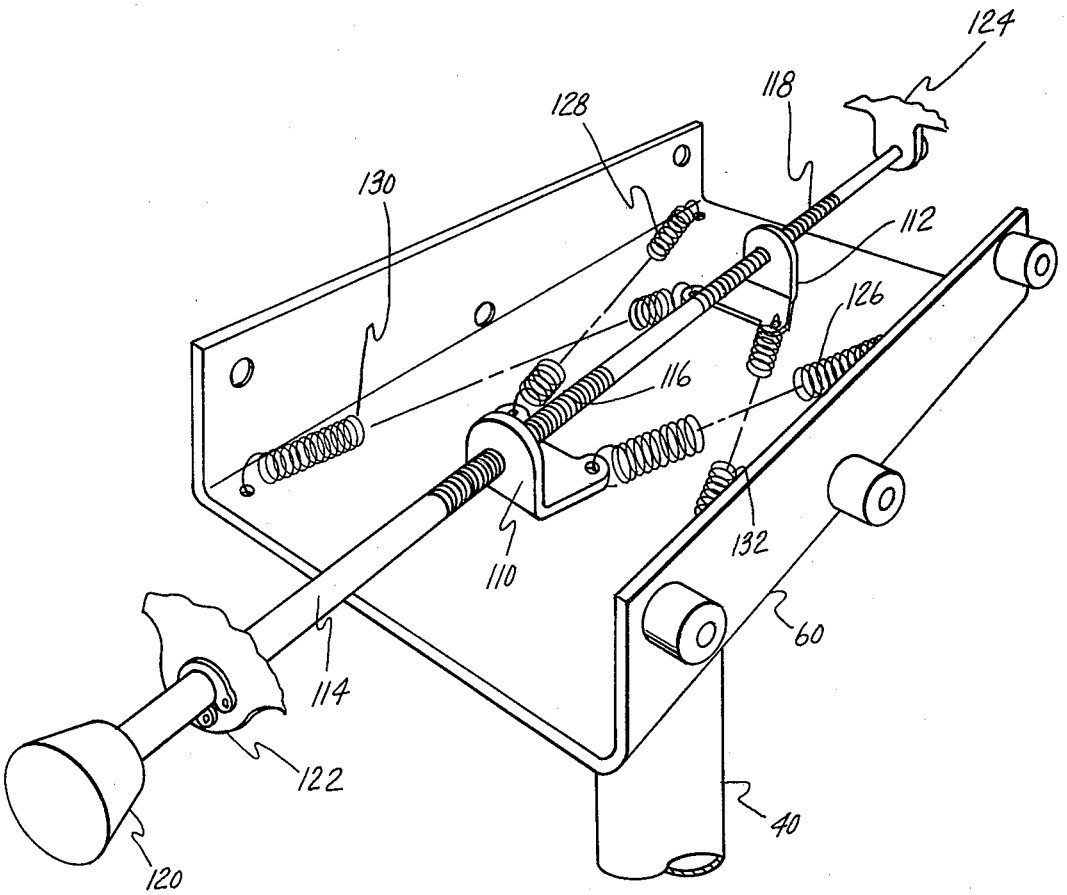
FIG. 9 is a perspective view similar to FIG. 8 of another embodiment.

FIG. 9 illustrates a modified form of construction of the mechanism of FIG. 8. The same reference numerals identify similar component parts. The principal difference resides in the arrangement and construction of the yieldably resilient members. In this embodiment the band 102 is replaced by a pair of individual helical coil spring members 126 and 128 while the band 104 is replaced by helical coil spring members 130, 132. The spring members 126, 128 are connected at one end to bracket 110 and at the opposite end are anchored in holes along the rear edge of member 60. In analogous manner the ends of springs 130, 132 are connected to bracket 112 while their opposite ends are anchored along the front edge of member 60. The operation of the mechanism of FIG. 9 insofar as the occupant is concerned is the same as that described in connection with the FIG. 8 embodiment.

Figures 10, 11:
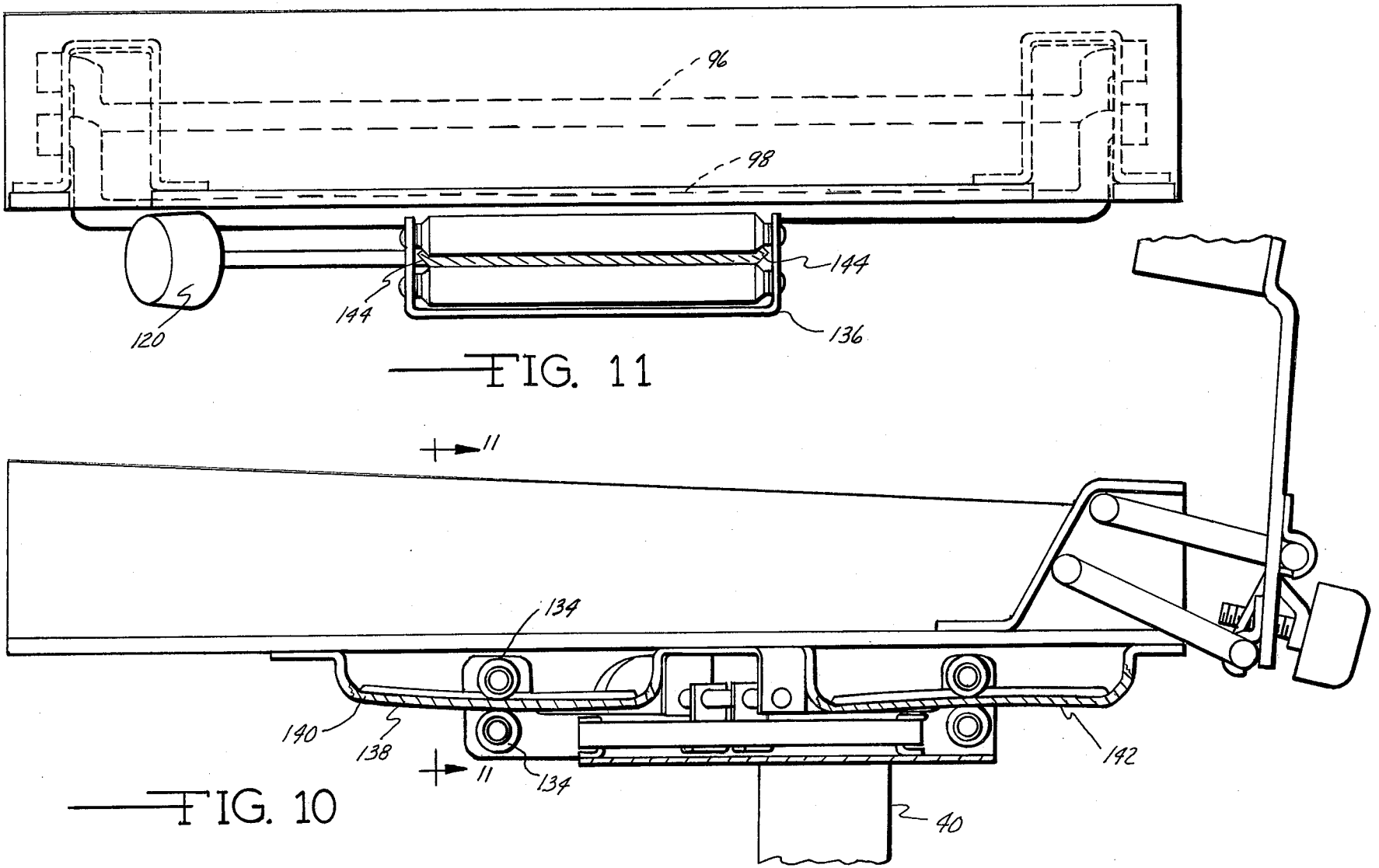
FIG. 10 is a fragmentary side elevational view partly in section of a further embodiment of chair.
FIG. 11 is sectional view taken substantially in the direction of arrows 11—11 in FIG. 10.

FIGS. 10 and 11 illustrate a further embodiment of chair. In this embodiment the components corresponding to the previously described components of the earlier embodiments are identified by like reference numerals. The chair back reclining mechanism is basically the same as in the FIGS. 6 and 7 embodiment. The principal difference resides in the construction and arrangement for mounting the chair for rocking motion on the upright.

This embodiment comprises four elongated rollers 134 which are mounted on a U-shaped member 136 which is similar to the member 60 of the earlier embodiment. The ends of the rollers 130 are journaled on the upturned flanges at the front and at the rear of member 136 with the two front rollers being in substantial vertical alignment and with the two rear rollers likewise being in substantial vertical alignment. Affixed to the seat is a track member 138. The track member 138 comprises a front track segment 140 engaged by the front set of rollers 134, and it also comprises a rear track segment 142 engaged by the rear set of rollers 134. As perhaps best seen in FIG. 11 the marginal side edges of the track segments 140, 142 are upturned as at 144 to laterally constrain the upper rollers, and hence all rollers, thereby preventing any lateral slack in the fore and aft motion.

The track segments 140, 142 are contoured as shown in FIG. 10 to provide the desired rocking motion when the seat is rocked fore and aft.

Fabrication of the chair may be accomplished by placing the chair seat including the member 142 onto the lower set of rollers 134 and then assembling the upper set of rollers. It should also be pointed out in FIG. 11 that the overall shape of the four bar link mechanism rods for the seat back is shown in a lateral view and this is representative of the construction previously described for the FIG. 6 and 7 embodiment. The embodiment of FIGS. 10 and 11 also incorporates a tension adjustment mechanism for providing a yieldable resistance to the fore and aft rocking motion of the seat on the upright. This arrangement differs slightly in that the tensioning adjustment is canted to one side instead of being fore and aft; it will still be effective however to provide a range of tension adjustments.

FIG. 12 illustrates the construction for the right hand arm of the chair. The construction of the left-hand arm is symmetrically opposite. The arm comprises an arm support member 146 which is secured to the underside of the chair seat at 148. From its attachment point to the chair seat the arm support member projects laterally and upwardly to terminate in an end 150. The plane of the end 150 is generally horizontal and an armrest base member 152 is secured to the end 150, being attached by means of screws 154 passing through holes in the base 152 and into tapped holes in the end 150.

In the fully assembled arm an armrest cover 156 is disposed on top of base 152 so that the two define an enclosure, the interior of the armrest cover 156 being hollow. It will be noted that an aperture 158 is provided at the forward end of the armrest cover 156.

In the assembled armrest a hand grip 160 is disposed at the forward end. A shaft 162 is secured to the rear edge of hand grip 160 by means of screws 164 which pass through suitable clearance holes in a plate affixed to the end of shaft 162 to engage corresponding tapped holes in hand grip 160. The shaft 162 has a non-circular cross section for a majority of its length; in this particular instance the cross section is rectangular. The shaft 162 at its non-circular cross section is guided for fore and aft movement by means of a guide bracket 166 which is disposed over the shaft and attached along the front marginal edge of base 152 by means of screws 168.

A helical coil spring 170 is disposed over the rear end of shaft 162 so that the front of the spring bears against the rear of bracket 166. The rear of the spring 170 is disposed against a retaining ring 172 which has been assembled onto a corresponding circular groove 174 at the far end of shaft 162 after the spring 170 has been inserted onto the shaft. The spring characteristics are such that the spring acts to urge, or bias, the shaft 162, and hence hand grip 160, in the rearward direction so that the rear edge of the hand grip 160 abuts the front edge of the armrest cover member 156. The aperture 158 provides clearance for shaft 162.

In use in the activity mode illustrated in FIGS. 4 and 12*a* the occupant grasps hand grip 160 and urges it fore and aft. As the hand grip is urged forwardly shaft 162 extends from the armrest and the spring 170 is increasingly compressed as the hand grip is increasingly extended. The attachment of the armrest cover 156 to the base plate 152 is completed by means of an attachment screw 176.

FIG. 13 illustrates a further optional accessory feature which may be used in any of the embodiments of chair disclosed herein. This accessory feature is a lock for locking the chair seat in a fixed position with respect to the upright. Typically the lock will be designed for locking the chair seat in the neutral position (i.e., centered) position, but it may be arranged to provide locking in different positions if desired. The construction for the lock comprises a locking lever 178 pivotally mounted at 180 on the seat. The lever is operable in the directions indicated by the double headed arrow 182 between a solid line unlocked position and a broken line locked position. The near end of the lever as viewed in FIG. 13 comprises an operating knob 184; the opposite end of the lever comprises a down-turned tang 186. The member 60 is provided with a slot 188. When the slot 188 is in alignment with the circularly contoured arc of travel of tang 186 about pivot 180, the tang may be lodged in the slot by operating the lever from the solid line to the broken line position. When the tang is so lodged, an interference is created which precludes the seat from being rocked fore and aft. When the lever is operated to the unlocked solid line position the chair may be operated in the manner described above.

Figure 15:
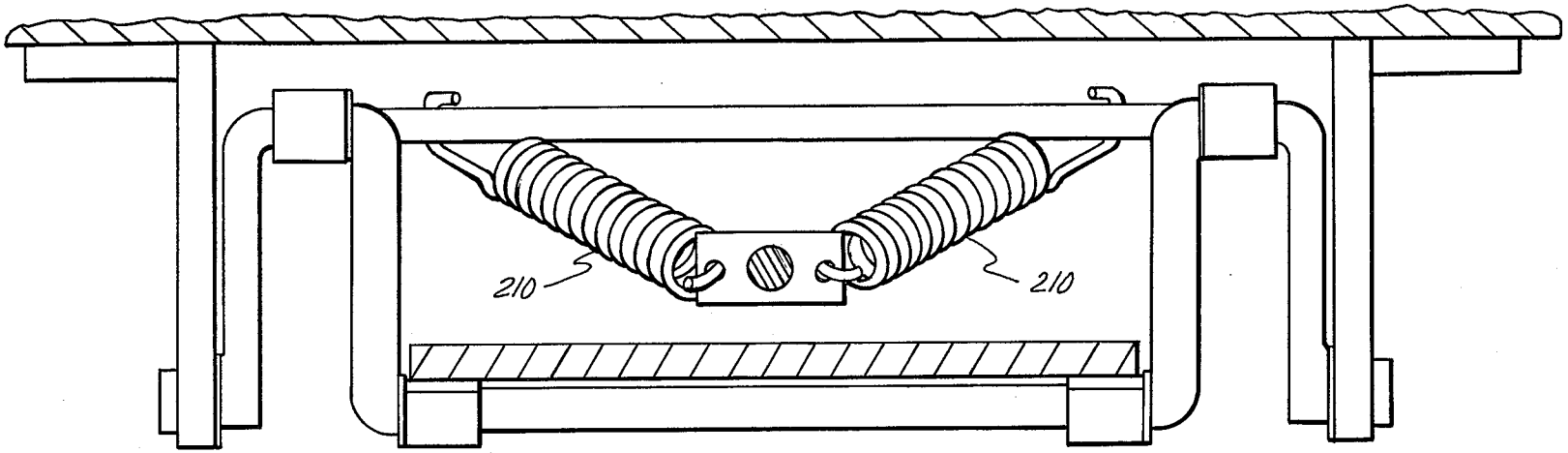
FIG. 15 is a sectional view taken substantially in the direction of arrows 15—15 in FIG. 14 and enlarged.
Figure 14:
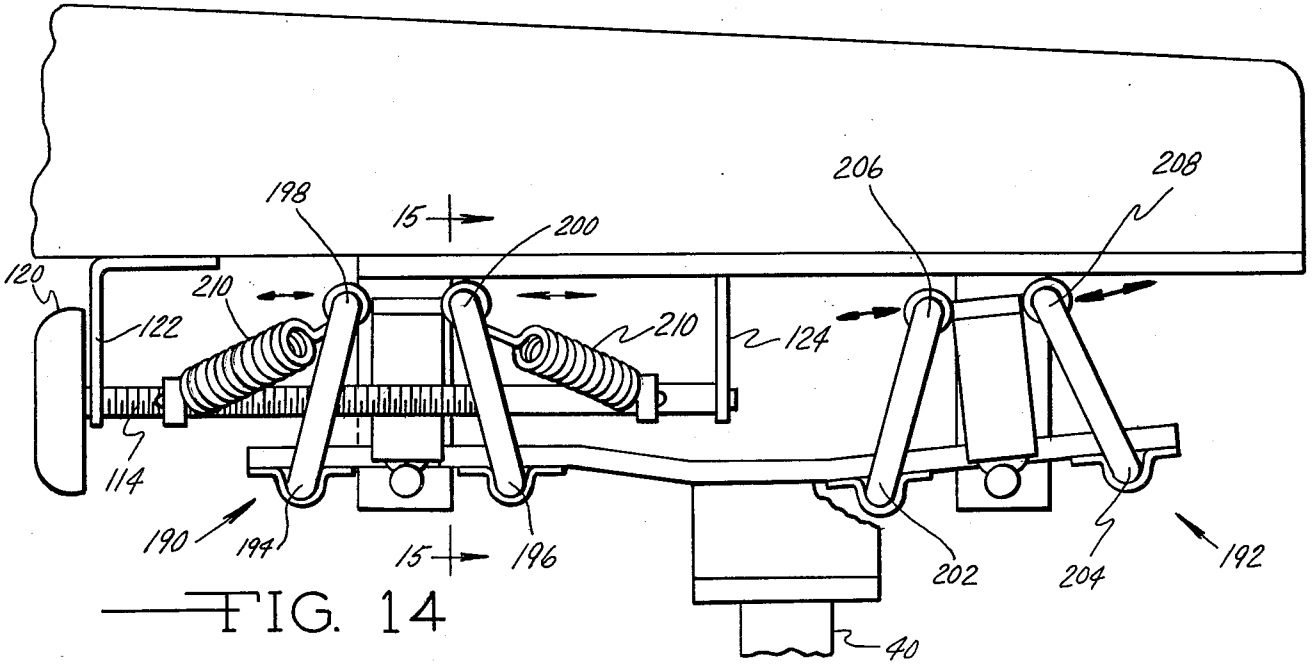
FIG. 14 is a fragmentary side elevational view of a further embodiment of chair.

FIGS. 14 and 15 illustrate a still further embodiment of chair. In this embodiment the fore and aft displacement of the chair seat on the upright is provided by a pair of double arm suspensions 190, 192. The suspension 190 is disposed forwardly on the pedestal while the other suspension 192 is rearwardly of the pedestal. As viewed laterally in FIG. 14 the double arm suspension is equivalent to a four bar linkage. In the case of the forward suspension 190 one fixed link is defined between the two pivots 194, 196. The other fixed link is defined between the pivots 198, 200. The movable links are therefore defined, one as the link between the pivots 194, 198 and the other as between the pivots 196, 200.

The rear suspension is equivalent and has a fixed link defined between the pivots 202, 204 and a fixed link defined between the pivots 206, 208. The movable links are therefore defined by the pivots 202, 206 for one link and 204, 208 for the other link. Thus as the chair seat is displaced fore and aft on the upright the two double arm suspensions execute motion indicated generally by the arrows.

A yieldable resistance mechanism for the fore and aft motion is also provided. This is associated with only the front suspension and it comprises four helical coiled springs 210 connected as shown. The operation is analogous to that described in connection with the preceding embodiments.

Figure 16:
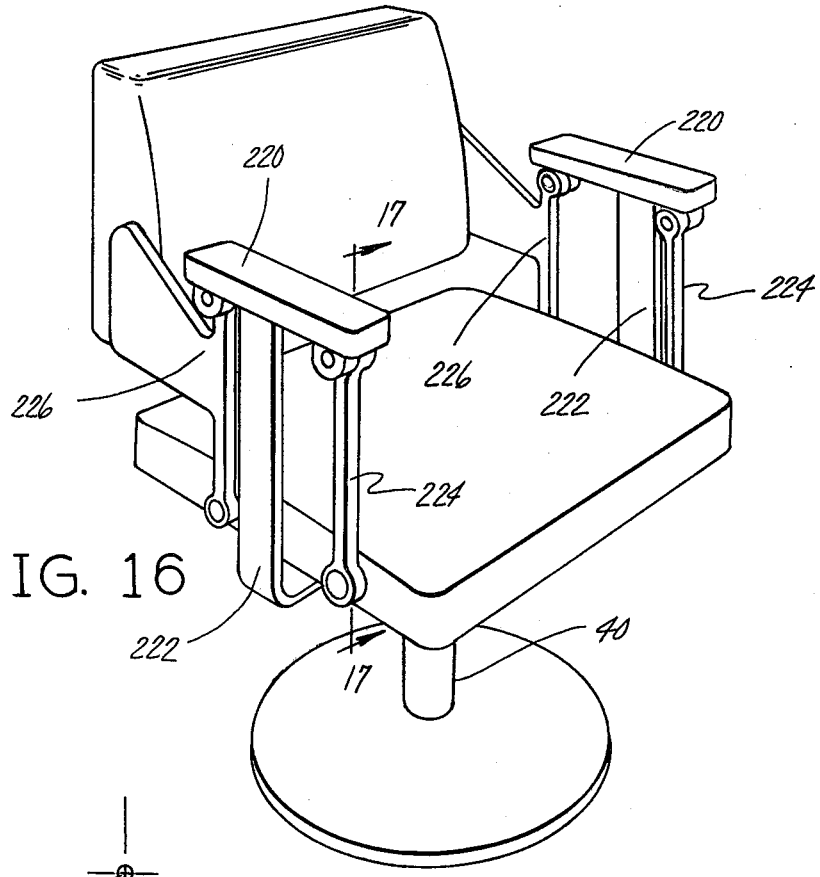
FIG. 16 is a perspective view of another embodiment of chair.
Figure 18:
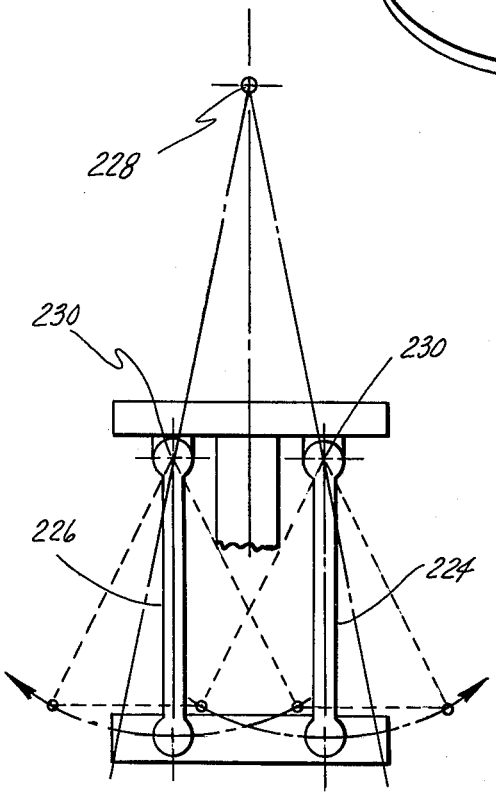
FIG. 18 is a diagrammatic view illustrating the action of the chair of FIG. 16.
Figure 17:
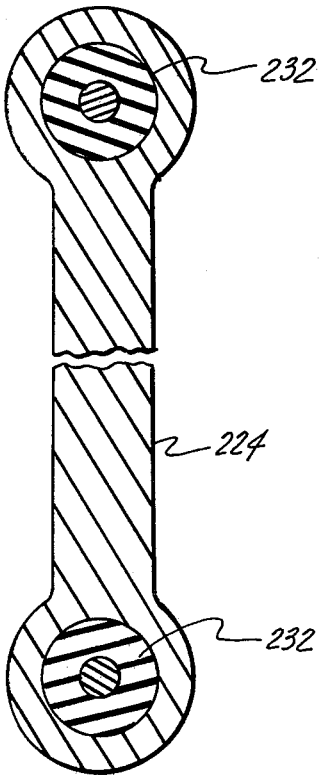
FIG. 17 is a vertical sectional view taken substantially in the direction of arrows 17—17 in FIG. 16 and enlarged.

FIGS. 16, 17 and 18 illustrate a still further embodiment of chair. In this embodiment the chair seat and the chair back are not pivotally related to each other. The seat and the back unit is supported on the upright 40 by means of the chair arms 220. The illustrated chair arms do not comprise the hand grip activity mechanism which was described in connection with FIG. 12 although if desired they could incorporate it. The arms have members 222 each affixed at one end to the upright. The other end supports an arm rest 224. The chair and seat unit is suspended from the armrests by means of a pair of suspension arms 224 at the front and a pair 226 at the rear. The forward arms 224 connect between the armrest and the seat while the rear arms serve to not only connect the seat to the armrest but they also provide a means for attaching the back to the seat in a fixed angular relationship of the back to the seat.

FIG. 18 diagrammatically illustrates the rocking motion which can be imparted to the chair seat by the occupant. As in the earlier embodiment the numeral 228 indicates the pivot point which is centered at the occupant's head. The rocking motion occurs with the arms 224, 226 pivoting fore and aft about axes which are centered at their points of attachment to the respective armrests. These fixed pivot points are designated by the reference numeral 230. In the neutral position the arms are perpendicular so that the four bar linkage defined thereby constitutes a rectangular linkage which assumes a parallelogram shape when the seat is displaced either forwardly or rearwardly.

FIG. 17 illustrates the detailed construction for the suspension arms and is particularly shown for one of the front arms 224. Disposed within the arm at each pivot point, both at the top and the bottom, is an annular yieldable resistance 232 which may take the form of an elastomeric bushing. The elastomeric bushing is associated with the arm in such a way that as the arm swings fore and aft from the vertical neutral position the elastomeric elements are torsionally stressed thereby imparting a yieldable resistive force to the rocking motion which is created by the action of the occupant. The nature of the coupling is such that the resistance progressively increases as the chair is increasingly displaced from the neutral position.

Figure 19:
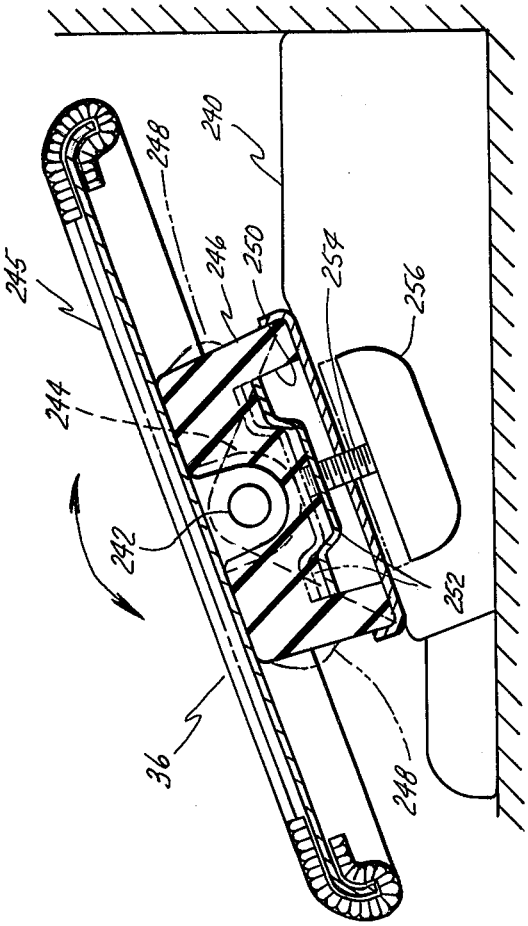
FIG. 19 is a vertical sectional view through another portion of the work station of FIG. 1 as taken in the direction of arrows 19—19.

FIG. 19 illustrates details of the foot pedal pumping mechanism 36. The mechanism comprises a base 240 which is positioned at the user's feet, on the floor for example. A lateral shaft 242 is supported on base 240 by means of laterally spaced brackets 244. The foot treadle plate 245 is pivoted on shaft 242. Thus the foot treadle plate is capable of being rocked clockwise and counterclockwise about the shaft 242.

In order to provide a yieldable resistance to the foot pumping action when the treadle plate is operated by an occupant, an elastomeric element 246 is disposed between the underside of the foot treadle plate and the confronting opposite face of the base 240. The element is configured to provide clearance for the shaft 242. Thus when the treadle plate is operated back and forth, the elastomeric element deforms, as represented by the deformations shown in the broken lines 248, to provide resistance to the pedal pumping action. Accordingly, the occupant encounters a resistance which has a beneficial therapeutic effect as explained above.

The underside of the elastomeric element 246 includes a pocket 250. A plate-like element 252 fits closely within pocket 250. The plate-like element is threaded onto a threaded shaft 254 which extends from base 240 into the pocket 250. The opposite end of the shaft contains a knob 256. When the knob 256 is rotated, the plate 252 is displaced to either compress or relax the engagement with the elastomeric member. In this way the elastomeric member may be pre-stressed to a desired amount thereby serving to establish the magnitude of the resistive forces which are encountered when the foot pedal pumping mechanism is put to use.

Figure 20:
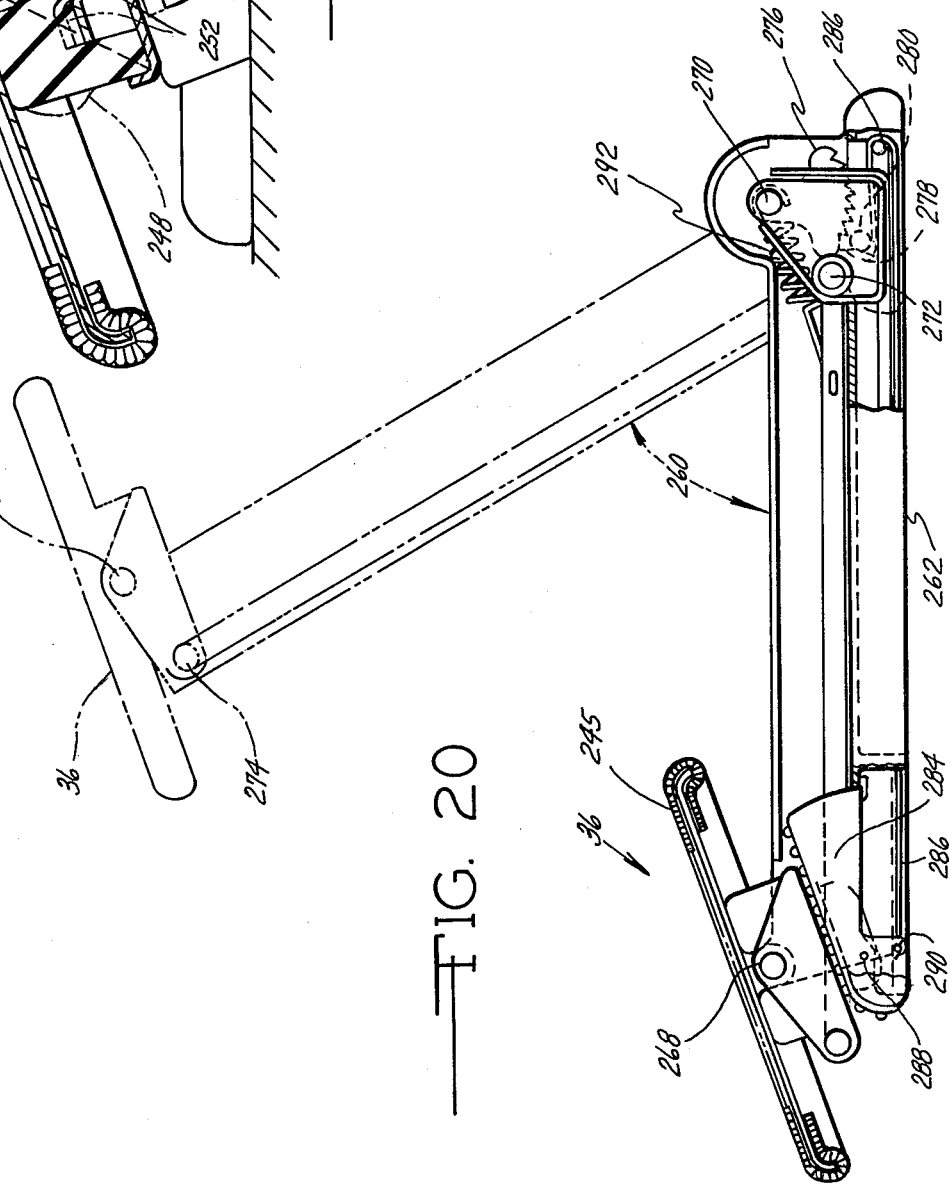
FIG. 20 is a modified form of the apparatus of FIG. 19.
Figure 21:
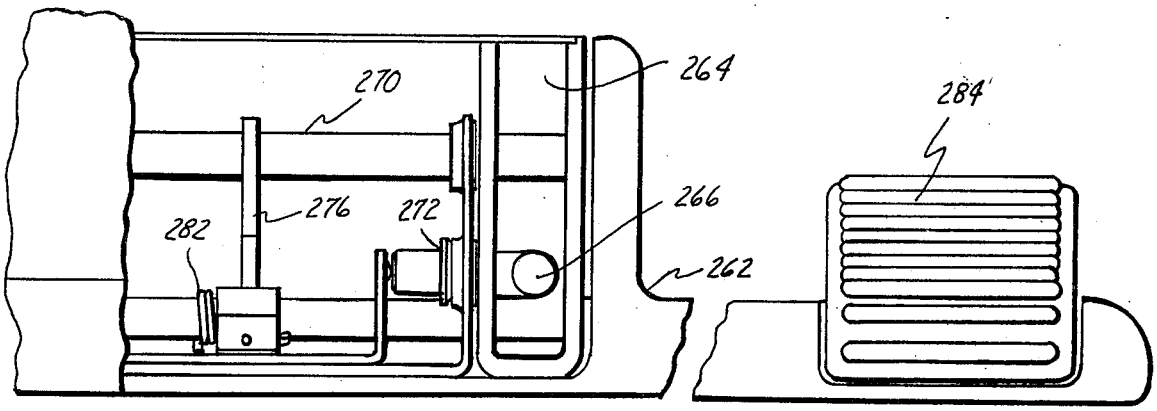
FIG. 21 is a fragmentary top plan view of the apparatus of FIG. 20.

FIGS. 20 and 21 illustrate a further embodiment of foot pedal pumping mechanism. The basic mechanism with respect to the foot pedal pumping activity is the same as in the embodiment of FIG. 19; however the FIG. 20 and 21 embodiment possesses an additional mechanism which can selectively elevate the pumping mechanism to a suitable elevation for accommodation of the particular requirements of individual occupants. Thus FIG. 20 illustrates the manner in which the foot pumping mechanism may be elevated. The solid line position illustrates the low position while the broken line position illustrates the full elevated position. There are a range of adjustment positions in between which may be selected as desired.

The foot pedal pumping mechanism is supported at one end of an elevating arm mechanism 260. The elevating arm mechanism 260 is in turn supported on a base 262. The elevating arm mechanism is in the form of two U-shaped channels 264 each connected at a lateral side of the pedal pumping mechanism. Disposed within each of the two channels 264 is a connecting link 266. Each channel has a pivotal connection to the foot pedal pumping mechanism at 268 and to the base 262 via a shaft 270. Each link 266 pivoted at 272 on the base and at 274 on the pedal pumping mechanism. Thus the elevating arm comprises a four bar linkage mechanism which is effective to maintain the foot treadle plate 245 in approximately the same attitude over the full elevational range. This means that the treadle plate is disposed at approximately the same acute angle of inclination toward the occupant from the horizontal so that it is always in a reasonably convenient attitude for use.

Associated with the embodiment is a latching mechanism which is effective to lock the elevating arm in a desired elevational position. This latching arrangement comprises a toothed latch sector plate 276 which is affixed to shaft 270. Confronting the toothed portion of the latch plate on base 262 is a pawl 278. The pawl 278 is pivoted on a shaft 280 and is biased in a clockwise sense as viewed in FIG. 20 to engage one of the serrations of the latch plate 276. A helical coil spring 282 (FIG. 21) biases the pawl toward this position. When the pawl is engaged with one of the serrations of the latch plate, the latch plate is precluded from rotation in either direction, and hence the foot pedal pumping mechanism is locked against any change in elevation.

Release of the pawl is accomplished by a release mechanism which includes a release pedal 284 and a cable 286. The release pedal 284 is pivoted on base 262 to one side of the unit. It is pivotally mounted to pivot about an axis 288. FIG. 20 illustrates the pedal and the latching mechanism in the latching position. One end of the cable is connected to the pedal at 290 while the opposite end is connected to a point on the pawl diametrically opposite the portion of the pawl which is engaged with the latch plate. When the release pedal 284 is depressed (i.e. pivoted clockwise as viewed in FIG. 20), the cable is actuated to rotate pawl 278 in the counterclockwise direction to a position where it is clear of the latch plate 276. This therefore releases the elevating arms so that the elevation may be changed.

A counterbalance spring 292 is arranged between the shaft 270 and the connecting links 266 so as to counterbalance the weight of the pumping mechanism.

When the desired elevation has been obtained, the pedal is released and the latching pawl is returned to latching engagement with the latching plate by the action of spring 282. Thus with this embodiment of the invention it is unnecessary to provide an individual foot pumping mechanism for each given individual and/or seating configuration, and the illustrated embodiment can accommodate the requirements for virtually all individuals and seating arrangements.

Figure 22:
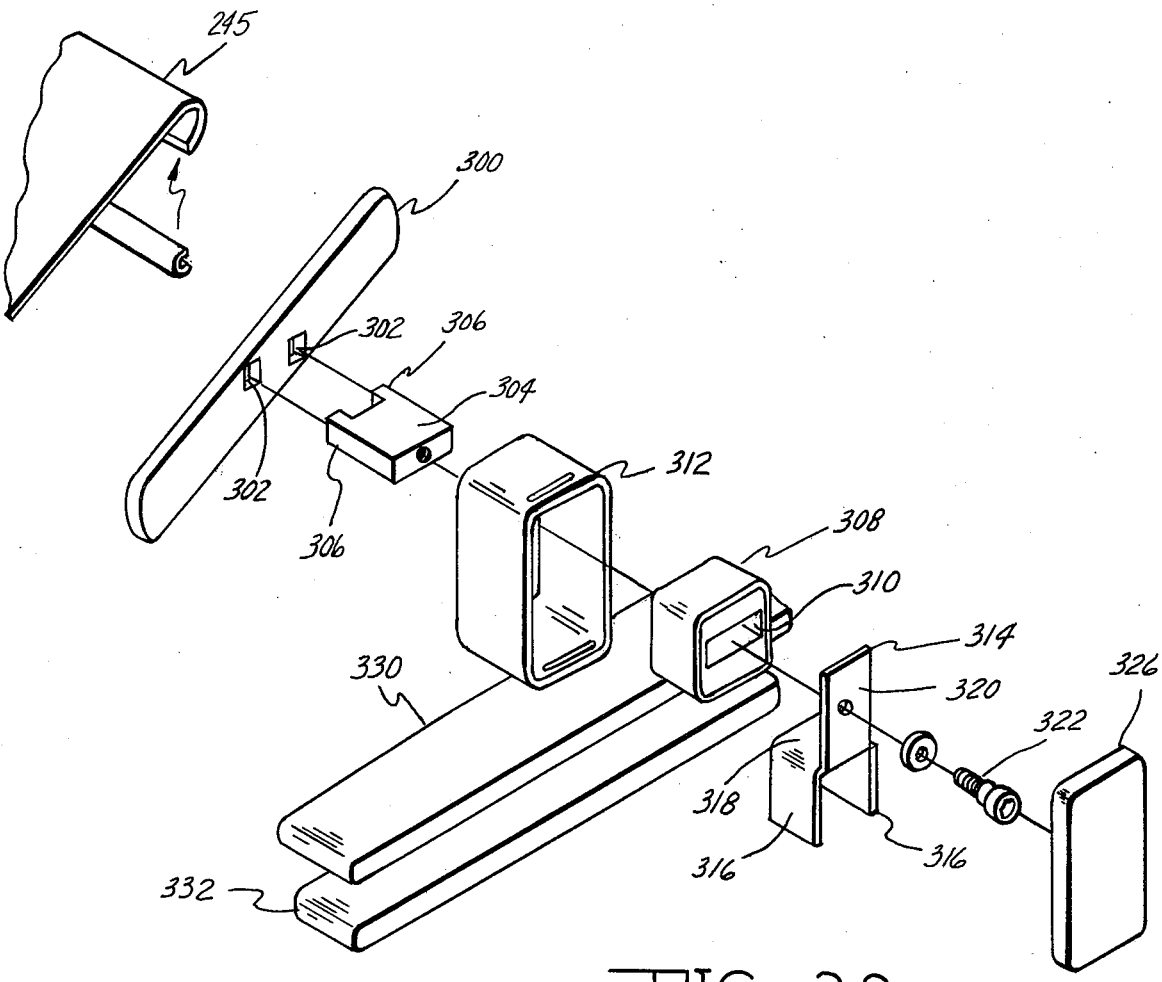
FIG. 22 is an exploded perspective view of a further embodiment.

FIG. 22 illustrates still another embodiment of foot pedal pumping mechanism. In this embodiment a side plate 300 of the foot treadle contains a pair of non-circular apertures 302. A tab 304 has matching projections 306 fitting in apertures 302. An elastomeric bushing 308 contains a rectangular aperture 310 which allows the bushing to be fitted over tab 304. A rectangular can 312 in turn fits over bushing 308. The rectangular can 312 is dimensioned to provide a close horizontal fit with the bushing. Vertically the bushing is supported within the can 132 by means of a support bracket 314. The support bracket 314 has depending legs 316 which rest on the lower wall of can 312, and a ledge 318 disposed against the lower side edge of the bushing. An upstanding leg 320 of the support bracket is disposed against the lateral outside face of bushing 308 to laterally confine the bushing within the can. The bushing is confined vertically with a close fit between the ledge 318 and the top wall of can 312. The bracket 314 is assembled to the unit by a screw 322 passing through the aperture in the upstanding leg of the support bracket to thread into a tapped hole in the end of tab 304. The assembly is enclosed by means of cover 326 which covers the open right hand end of the can. The can is in turn affixed to a metal plate 330 itself in turn affixed to an underlying rubber piece 332. With this arrangement the operation of the foot pedal causes the tab 304 to rotate. The rotation of the tab is taken up by deformation of the elastomeric bushing confined within the can by the support bracket. The bushing experiences in general a torsional action in response to operation of the foot treadle and this provides a yieldable resistance to the pumping action.

Thus a new and useful office seating system has been disclosed which allows sedentary workers to execute exercise activities thereby promoting improved work performance and physiological well being.

What is claimed is:

1. In a work station wherein an individual occupies a seated position while working, the improvement which comprises a seating arrangement for the individual which concurrently provides both for stability of certain portions of the individual's body in conducting work tasks at the work station and for mobility of certain other portions of the individual's body to engage in therapeutic activities while conducting work tasks, said seating arrangement comprising a seat mounted on an upright by a mechanism which allows fore and aft motion of the seat relative to the upright thereby providing for mobility by fore and aft rocking of the seat so that the individual, by leg action, can generate rocking motion while maintaining his or her head stabilized for conducting work tasks, said mechanism comprising one or more rollers operatively engaged with a track providing a fore and aft motion by rolling engagement of the rollers with the track, a yieldable resistance which is effective to yieldably resist with increasing force increasing fore and aft displacement of the seat from a neutral position, and adjustment means for said resistance effective to enable the individual to set the magnitude of the resistive forces which are encountered during fore and aft displacement of the seat on the upright.

2. The improvement set forth in claim 1 wherein the adjustment means for the resistance comprises four yieldalby resistive elements arranged in a four-sided configuration with a means for setting the relative position of two diagonally opposite points of the four-sided configuration.

3. In a work station wherein an individual occupies a seated position while working, the improvement which comprises a seating arrangement for the individual which concurrently provides for stability of certain portions of the individual's body in conducting work tasks at the work station and for mobility of certain other portions of the individual's body to engage in therapeutic activities while conducting work tasks, said seating arrangement providing for mobility of one or both arms by allowing the individual to manually grasp a handgrip portion of an armrest and manipulate that portion with respect to the remainder of the armrest, said seating arrangement comprising a fixed armrest portion and a handgrip portion at the front of the fixed arm rest portion and means yieldably coupling the handgrip portion with the fixed armrest portion to provide a yieldable resistance to a forward motion of the individual's arm when manipulating the handgrip portion.

4. The improvement set forth in claim 3 in which the fixed armrest portion comprises a hollow interior with the handgrip portion having connected thereto a shaft which extends through an aperture in the fixed armrest portion into the hollow interior thereof and including for the yieldable coupling means a compression spring member which is disposed around the shaft interior of the armrest so as to be compressed when the handgrip portion is urged forwardly by the individual.

5. In a work station wherein an individual occupies a seated position while working, the improvement which comprises a seating arrangement for the individual which concurrently provides both for stability of certain portions of the individual's body in conducting work tasks at the work station and for mobility of certain other portions of the individual's body to engage in therapeutic activities while conducting work tasks, said seating arrangement providing for mobility of the individual's feet by means of a foot pumping mechanism comprising a treadle plate pivotally mounted about a pivot axis through a yieldable resistance.

6. The improvement set forth in claim 5 in which the yieldable resistance comprises an elastomeric member.

7. The improvement set forth in claim 6 including adjustment means for adjustably deforming the elastomeric member to in turn adjust the character of the yieldable resistance of the foot pumping mechanism.

8. The improvement set forth in claim 5 including means to elevate the treadle plate to selected elevational positions and means for maintaining the treadle plate in approximately the same attitude throughout the range of its elevational positions.

9. The improvement set forth in claim 8 in which the treadle plate and yieldable resistance are mounted on a four-bar linkage elevating mechanism pivotted on a base to maintain the treadle plate in approximately the same attitude throughout its various elevational positions.

10. The improvement set forth in claim 9 including a latching mechanism which is effective to latch the elevating means in selected elevational positions and means to release the latching means when the elevation is to be changed.

* * * * *